United States Patent [19]

Evans

[11] Patent Number: 4,992,193

[45] Date of Patent: Feb. 12, 1991

[54] GRANULAR DETERGENT COMPOSITION INCLUDING SOAP NOODLES THAT CONTAIN FREE FATTY ACID TO IMPROVE DISSOLUTION

[75] Inventor: Elfed H. Evans, Clwyd, Great Britain

[73] Assignee: Lever Brothers Company Division of Conopco, Inc., New York, N.Y.

[21] Appl. No.: 318,499

[22] Filed: Mar. 2, 1989

Related U.S. Application Data

[63] Continuation of Ser. No. 109,899, Oct. 19, 1987, abandoned.

[30] Foreign Application Priority Data

Oct. 24, 1986 [GB] United Kingdom ..... 8625474

[51] Int. Cl.[5] ..... C11D 9/04; C11D 9/48; C11D 10/04; C11D 17/06

[52] U.S. Cl. ..... 252/92; 252/132; 252/134; 252/174; 252/363.5; 252/368; 252/370

[58] Field of Search ..... 252/109, 134, 174, 367, 252/368, 369, 370, 363.5, 132, 92

[56] References Cited

U.S. PATENT DOCUMENTS

| | | | |
|---|---|---|---|
| 3,576,748 | 4/1971 | Petersson | 252/110 |
| 3,993,722 | 11/1976 | Borcher | 264/75 |
| 4,082,682 | 4/1978 | Inamorato | 252/92 |
| 4,310,479 | 1/1982 | Ooms et al. | 264/37 |
| 4,416,811 | 11/1983 | Wixon | 252/8.75 |

FOREIGN PATENT DOCUMENTS

| | | | |
|---|---|---|---|
| 1204123 | 9/1970 | United Kingdom | 252/106 |
| 1587430 | 4/1981 | United Kingdom . | |

*Primary Examiner*—Dennis Albrecht
*Assistant Examiner*—Erin M. Harriman
*Attorney, Agent, or Firm*—James J. Farrell

[57] ABSTRACT

A detergent powder contains soap-based noodles also containing 2 to 15% of free fatty acid and 1.5 to 5% of an inorganic salt such as sodium chloride. The free fatty acid improves the dissolution rate of the noodles, while the salt compensates for the softness of the soap composition, due to the free fatty acid, that makes noodle production difficult.

8 Claims, No Drawings

GRANULAR DETERGENT COMPOSITION INCLUDING SOAP NOODLES THAT CONTAIN FREE FATTY ACID TO IMPROVE DISSOLUTION

This is a continuation application of Ser. No. 109,899, filed Oct. 19, 1987 now abandoned.

TECHNICAL FIELD OF INVENTION

The present invention relates to detergent powders containing noodles consisting predominantly of soap.

BACKGROUND AND PRIOR ART

Detergent powders often contain minor amounts of coloured speckles or noodles which may be carriers for special additives such as catalysts, enzymes, fluorescers or photobleaches and/or may be used to highlight particular attributes of the detergent powders. The term "speckles" is used to denote granules or particles which are generally not too dissimilar to the granules or particles of the powder itself, other than in their colours, while the term "noodles" is used to refer to generally cylindrical particles prepared by extrusion and cutting or breaking: noodles generally, but not always, contain soap as a major ingredient. Coloured speckles have been used far more extensively than coloured noodles for two reasons: manufacture of satisfactory soap-based noodles can present problems, and the noodles themselves can be slow to dissolve when the detergent powder is used by the consumer.

Noodles based on soap are commonly produced by mixing dried soap chips with colourants and other minor ingredients, homogenising by working in either a mill or a refiner, and then extruding through a perforated plate with fine holes. They are generally extruded continuously and then allowed to weather sufficiently to break up into pieces from 3 to 15 mm in length. A series of rotating knives can be fitted to the face of the plate to cut the extruded noodles automatically into suitable lengths, but these tend to cause a certain amount of bunching to take place. The degree of bunching depends on the geometry of the cutting knives and holes, and is also greatly affected by the plasticity and stickiness of the noodles themselves. Even where a rotating knife is not used, the quality of the noodles is very dependent on the physical properties of the extruded soap. Ideally, the soap should be sufficiently plastic to extrude satisfactorily through the holes in the perforated plate but not so soft and sticky that they bunch together after extrusion. They should also be sufficiently hard and brittle to break up into the desired length range.

Another potential problem with soap-based noodles is their solubility and rate of dissolution. Although soap has excellent solubility in warm and hot water, the solubility in tepid water can be poor. Poor solubility of the soap noodles could therefore present a problem in a low sudsing detergent powder when used in automatic machines at low wash temperatures.

It has now been discovered that the manufacture of soap noodles is simplified and the dissolution improved, by incorporating in the noodles a certain proportion of free fatty acid and an inorganic salt.

DEFINITION OF THE INVENTION

The present invention accordingly provides a particulate detergent composition comprising one or more anionic and/or nonionic non-soap detergent active compounds, one or more detergency builders, and from 0.5 to 10% by weight of the composition of noodles consisting essentially of: (i) from 63 to 88% by weight of one or more soaps of $C_8$–$C_{20}$ fatty acids; (ii) from 2 to 15% by weight of one or more $C_8$–$C_{20}$ fatty acids; (iii) from 1.0 to 5% by weight of one or more inorganic salts; (iv) optionally from 0 to 0.1% by weight of one or more dyestuffs; and (v) from 6 to 16% by weight of water.

DESCRIPTION OF THE INVENTION

The noodles of use in the present invention contain soap as a major ingredient, present in an amount of from 63 to 88% by weight. Any soap of a $C_8$–$C_{20}$ fatty acid, or any mixture of such soaps, is suitable for use in the present invention, but the soap may be chosen to optimise the dissolution characteristics of the noodles. The solubility of a soap, especially at lower temperatures, is related both to the chain length of the fatty acid moiety and to the nature of the cation. Advantageously the soap used contains a proportion of more soluble soaps derived from nut oils, such as coconut, palm kernel or babassu, which are rich in the more soluble short chain ($C_6$ and below) materials. The remainder of the soap used will generally be derived from tallow class fats which may be partly hardened, especially when the noodles are to be used to moderate the lather of a non-soap-based detergent powder. Examples of suitable commercially available soap blends are 80% tallow/20% coconut, 60% tallow/40% coconut and 55% tallow/45% coconut.

The noodles of use in the present invention also contain from 2 to 15% by weight, preferably from 5 to 10% by weight, of free fatty acid. The presence of free fatty acid has unexpectedly been found to improve substantially the rate of dissolution of the noodles.

The fatty acid or blend of fatty acids incorporated in the noodles of the invention may be the same as that from which the soap is derived, or different. For example, if the soap is a blend such as 80% tallow/20% coconut containing a relatively low proportion of short-chain soaps, a free fatty acid mix rich in short-chain material may be added to increase the overall proportion of such soaps in the composition: of course a certain amount of interchange will take place between the free fatty acids incorporated and those combined with sodium or potassium cations in the soap.

The noodles of use in the invention will generally be prepared as described above, from dried soap chips which are mixed with any dyestuffs or other minor ingredients, homogenised in a mill or refiner, and then extruded. The free fatty acids may be added at any suitable stage in the process. They may be incorporated during the manufacture of the soap chips themselves, for example, added to the neat soap before or during the drying operation; alternatively they can be added to the dried soap chips and worked in during the homogenising stage.

An alternative method of ensuring a content of free fatty acid in the soap composition is to liberate free acid from the soap itself by adding an acid or acid salt at some stage during soap manufacture. A liquid acid, for example, alkylbenzene sulphonic acid, phosphoric acid or hydrochloric acid, may be incorporated into the neat soap before or during the drying operation; or an acid salt, for example, a sodium dihydrogen phosphate or sodium bisulphate, may be added to the soap chips at the homogenising stage in the mill or refiner. This alternative method cannot, of course, be used to incorporate fatty acids of a different composition to that of the soap, but it has the advantage that the noodles produced are generally firmer than those produced by adding the fatty acid itself.

The incorporation of free fatty acid in accordance with the invention improves the dissolution properties of the noodles, as previously mentioned, but has a disadvantageous side-effect: at any given moisture content, the soap is more soft and plastic. Although this makes milling, refining and extruding easier, it produces noodles that are likely to bunch together and that do not break down readily into desired lengths. It has now been discovered that this drawback can be corrected by including from 1.5 to 5% by weight, preferably from 2 to 4% by weight, of an inorganic salt in the noodles. The salt is preferably added in fine granular form, or as a concentrated solution or slurry, to the soap chips prior to the homogenising (milling or refining) step.

A preferred salt is sodium chloride, on grounds of cheapness, weight effectiveness, and availability in a fine granular grade. Other suitable salts include sodium sulphate and fine sodium tripolyphosphate. Hydratable salts are especially beneficial in improving the firmness of the noodles.

The noodles of use in the invention also contain from 6 to 16% by weight, preferably from 9 to 13% by weight, of water. Sufficient water may be present in the soap chips from which the noodles are prepared, but if desired additional water may be added at the homogenising (milling or refining) stage. The optimum level of inorganic salt that will give a noodle that is firm but not too hard will depend both on the free fatty acid level and the moisture level, and may readily be determined by routine experimentation.

It will generally be desirable for the noodles to be coloured, and a dyestuff will generally be mixed with the soap chips before homogenisation. Preferred colours are blue, green and pink, and examples of suitable dyestuffs include Monastral Green BNV, Ultramarine Blue, and mixtures of Ultramarine Blue with yellow pigments. Dyestuffs may suitably be present in amounts of up to 0.1% by weight, preferably from 0.03 to 0.06% by weight: higher levels can lead to fabric staining in use.

The rate of dissolution of the noodles is dependent on their size and it is preferred that they should have a cross-sectional diameter in the 0.3 mm to 2.0 mm range. Most preferably, the diameter should be in the range of from 0.6 to 1.2 mm. The term "diameter" denotes the average diameter because the cross sectional area could be circular if extruded through a drilled plate or square if extruded through a wire mesh supported by a strong plate perforated with larger holes of 20 mm or more in diameter. The length of the noodles should preferably be in the range of from 3 to 20 mm and more preferably in the range of from 5 to 12 mm.

The noodles of use in the present invention are incorporated in detergent powders. Coloured noodles consisting only of soap, fatty acid, salt, dyestuff and water, and minor amounts of preservative, may be incorporated in a white detergent powder primarily to provide a colour contrast effect: the soap also has a lather-moderating action. It is also within the scope of the invention to use the noodles as carriers for certain special ingredients, for example, catalysts, enzymes, fluorescers or photobleaches, that are to be incorporated in the detergent powder.

Detergent powders incorporating the noodles of use in the invention are based on non-soap detergent-active compounds which may be anionic and/or nonionic.

Anionic surfactants are well known to those skilled in the detergents art. Examples include alkylbenzene sulphonates, particularly sodium linear alkylbenzene sulphonates having an average chain length of about $C_{12}$; primary and secondary alcohol sulphates, particularly sodium $C_{12}$–$C_{15}$ primarly alcohol sulphates; olefin sulphonates; alkane sulphonates; and fatty acid ester sulphonates.

Nonionic surfactants that may be used in detergent powders according to the invention include the primary and secondary alcohol ethoxylates, especially the $C_{12}$–$C_{15}$ primary and secondary alcohols ethoxylated with an average of from 3 to 20 moles of ethylene oxide per mole of alcohol.

The total amount of detergent-active material (surfactant), excluding soap, in detergent powders according to the invention is preferably within the range of from 5 to 40% by weight. For powders intended for use in European front-loading automatic washing machines the preferred range is from 5 to 20% by weight, with a weight ratio of anionic surfactant to nonionic surfactant not exceeding 10:1, and preferably not exceeding 6:1.

Detergent powders in accordance with the invention will also comprise one or more detergency builders, suitably in an amount of from 10 to 60% by weight. Detergency builders are very well known to those skilled in the art and include sodium tripolyphosphate, orthophosphate and pyrophosphate; crystalline and amorphous sodium aluminosilicate; sodium carbonate; and monomeric and polymeric polycarboxylates, for example, sodium citrate, notrilotriacetate and polyacrylate, and acrylic copolymers.

Other inorganic salts without a detergency building function, for example, sodium silicate or sodium sulphate, may also be included in the detergent powders of the invention.

The detergent powders will also generally contain various additives to enhance the efficiency of the product, notably bleach systems, antiredeposition agents, fluorescers, lather suppressors, enzymes and perfumes.

Detergent powders in accordance with the invention may be prepared by any suitable method, for example, spray-drying, dry-mixing, granulation or agglomeration, or any combination of these techniques. The noodles of use in of the present invention will generally be incorporated in the powders by simple mixing. In a preferred procedure, a spray-dried base powder containing surfactants, builders, antiredeposition agents, fluorescers, sodium silicates, sodium sulphates is prepared, and heat-sensitive ingredients (bleach, enzyme, lather suppressor, perfume, liquid nonionic surfactant), plus the soap noodles of the invention, are postdosed to the base powder.

EXAMPLES

The invention is further illustrated by the following non-limiting Examples.

EXAMPLE 1

Green noodles 5-10 mm long and 0.5-1 mm in diameter were prepared to the following composition:

| | weight % |
|---|---|
| Soap (60% tallow, 40% coconut) | 78.32 |

-continued

| | weight % |
|---|---|
| Fatty acid (60% tallow, 40% coconut) | 6.35 |
| Sodium chloride | 2.25 |
| Green dyestuff (Monastral Green BNV) | 0.08 |
| Water | 13.00 |
| | 100.00 |

The noodles were prepared from dried chips of 60% tallow/40% coconut soap having a free fatty acid content of 7.5% by weight (based on total fatty matter); the free fatty acid had been incorporated into the neat soap during the drying stage.

95.77 parts by weight of the dried soap chips, made up of 78.32 parts by weight of soap, 6.35 parts of free fatty acid and 11.10 parts by weight of water, were mixed with 0.08 parts by weight of dyestuff (in paste form), 3.9 parts by weight of additional water and 2.25 parts of sodium chloride, and homogenised by milling; 2 parts by weight of water were lost by evaporation during this process. The homogenised mass was extruded through a perforated plate and, after weathering, broken into pieces (noodles) 5-10 mm long.

A similar composition containing only 2.00% by weight of sodium chloride was too soft for satisfactory noodling, while a similar composition containing 3.00% by weight of sodium chloride would extrude satisfactorily but on weathering became too brittle and broke up into very short noodles.

A spray-dried detergent base powder was prepared to the following composition:

| | parts by weight |
|---|---|
| Linear alkylbenzene sulphonate (Na salt) | 6.0 |
| Nonionic surfactant (7 EO) | 7.0 |
| Sodium tripolyphosphate | 25.0 |
| Sodium sulphate | 15.5 |
| Sodium silicate | 6.0 |
| EDTA | 0.1 |
| Sodium carboxymethyl cellulose | 0.5 |
| Moisture | 7.35 |
| | 67.45 |

Onto this base powder were sprayed 1 part by weight of lather suppressor and 0.25 parts by weight of perfume, to give a total of 68.7 parts by weight. The remaining 31.3 parts by weight were constituted by solid postdosed ingredients:

| | |
|---|---|
| Bleach ingredients (sodium perborate, TAED) | 14.0 |
| Enzyme marumes | 0.3 |
| Sodium sulphate | 15.0 |
| Green soap noodles | 2.0 |
| | 100.0 |

The resulting product was composed of white granules interspersed with distinctive green noodles.

EXAMPLE 2

Green noodles similar to those in Example 1 were prepared using dried soap chips made from an 82% tallow/18% coconut fat charge. The soap chips were superfatted during the drying stage with a fatty acid of the same composition at a level of 5% based on the soap's total fatty matter.

The green noodles comprised:

| | Weight % |
|---|---|
| Superfatted soap chips (82% tallow, 18% coconut) | 95.92 |
| Sodium Chloride | 2.00 |
| Monastral Green BNV | 0.08 |
| Water | 2.00 |
| | 100.00 |

A mixture of the above ingredients was homogenised by twice milling on a three roll mill. The homogenised mass was then extruded in a 75 mm diameter plodder through a perforated plate into long strands. These, after suitable weathering, were broken into noodles 5 to 10 mm long.

For comparison, similar noodles were prepared in the same manner using non-superfatted chips made from the same fat charge (82% tallow, 18% coconut).

The dissolution properties of the superfatted and non-superfatted (control) noodles were assessed by dissolving 4 g noodles in 400 ml of distilled water at a temperature of 35° C. The water, which was contained in a 600 ml beaker, was constantly stirred under carefully controlled conditions. After 2 minutes' stirring, the contents of the beaker were filtered under slight suction through a weighed terylene lawn cloth. After drying the cloths in an oven, they were reweighed and the amounts of undissolved soap calculated.

The comparative undissolved soap for the superfatted noodles and the non-superfatted control noodles were:

| | Undissolved weight % |
|---|---|
| Superfatted noodles at 9.6% moisture | 0.1 |
| Non-superfatted noodles at 11.5% moisture | 4.1 |

The rate of dissolution of the superfatted noodles is superior to that of the non-superfatted variant despite its containing 2% less moisture.

These results clearly demonstrates the beneficial effect of the free fatty acids on the dissolution rate of the soap noodles of the invention.

I claim:

1. A particular detergent composition comprising one or more anionic and/or nonionic non-soap detergent-active compounds and one or more detergency builders, characterized in that the composition additionally comprises from 0.5 to 10% by weight of the composition of noodles consisting essentially of:
   (i) from 63 to 88% by weight of one or more soaps of $C_8$–$C_{20}$ fatty acids;
   (ii) from 2 to 15% by weight or more $C_8$–$C_{20}$ fatty acids to improve the dissolution properties of the noodles;
   (iii) from above 2.0 to 5% by weight of one or more inorganic salts to reduce the tendency of the noodles to bunch together;
   (iv) optionally from 0 to 0.1% by weight of one or more dyestuffs; and
   (iv) from 6 to 16% by weight of water.

2. A detergent composition as claimed in claim 1, wherein the inorganic salt (iii) is sodium chloride.

3. A detergent composition as claimed in claim 2, wherein the noodles contain from above 2 to 4% by weight of sodium chloride.

4. A detergent composition as claimed in claim 3, wherein the noodles contain from 5 to 10% by weight of fatty acid (ii).

5. A detergent composition as claimed in any one of claim 1 wherein the noodles contain from 5 to 10% by weight of fatty acid (ii).

6. A detergent composition as claimed in any one of claim 1 wherein the noodles have a cross-sectional diameter within the range of from 0.3 to 2.0 mm and a length within the range of from 3 to 20 mm.

7. A detergent composition as claimed in any one of claims 1 to 6, wherein the noodles contain from 0.03 to 0.06% by weight of a blue, green, pink, or yellow dyestuff or a mixture of any two or more of the dyestuffs.

8. A detergent composition as claimed in claim 1, containing from 1 to 5% by weight of the noodles.

* * * * *

UNITED STATES PATENT AND TRADEMARK OFFICE

CERTIFICATE OF CORRECTION

PATENT NO. : 4,992,193

DATED : February 12, 1991

INVENTOR(S) : Evans et al.

It is certified that error appears in the above—identified patent and that said Letters Patent is hereby corrected as shown below:

Column 6, line 46

Change the word "particular" to --particulate--.

Signed and Sealed this

Twenty-fifth Day of August, 1992

*Attest:*

DOUGLAS B. COMER

*Attesting Officer*

*Acting Commissioner of Patents and Trademarks*